8-107 SR
FIP8309 XR 4,119,486

United States Patent [19]
Eckert

[11] 4,119,486
[45] Oct. 10, 1978

[54] PROCESS FOR BLEACHING WOOD PULP WITH OZONE IN THE PRESENCE OF A CATIONIC SURFACTANT

[75] Inventor: Robert C. Eckert, Charleston, S.C.

[73] Assignee: Westvaco Corporation, New York, N.Y.

[21] Appl. No.: 746,845

[22] Filed: Dec. 2, 1976

Related U.S. Application Data

[63] Continuation of Ser. No. 604,725, Aug. 14, 1975, abandoned.

[51] Int. Cl.[2] ..... D21C 9/10
[52] U.S. Cl. ..... 162/65; 8/107; 162/72; 162/76
[58] Field of Search ..... 162/65, 72, 74, 76, 162/83, 84, 87, 88; 8/107, 111; 260/567.6 R, 567.6 M

[56] References Cited

U.S. PATENT DOCUMENTS

| | | | |
|---|---|---|---|
| 2,466,633 | 4/1949 | Brabender et al. | 162/65 |
| 3,451,888 | 6/1969 | Ancelle et al. | 162/65 |
| 3,759,783 | 9/1973 | Samuelson et al. | 162/65 X |
| 3,769,152 | 10/1973 | Samuelson et al. | 162/65 |

FOREIGN PATENT DOCUMENTS

| | | | |
|---|---|---|---|
| 185,421 | 8/1922 | United Kingdom | 162/65 |
| 719,407 | 12/1954 | United Kingdom | 162/72 |

OTHER PUBLICATIONS

Casey, Pulp & Paper, vol. I, p. 457, 1960.
Secrist et al., "Studies on the Ozonation of Chemical Pulps," TAPPI Reprint, vol. 54, No. 4, 4-1971, pp. 581-584, 162-165.
Rothenberg et al., "Bleaching of Oxygen Pulps with Ozone," TAPPI, vol. 58, No. 8, 2-1975, pp. 182-185, 162-165.

*Primary Examiner*—Arthur L. Corbin
*Attorney, Agent, or Firm*—Richard L. Schmalz; Ernest B. Lipscomb, III

[57] ABSTRACT

A wood pulp slurry, at a consistency of 0.1% to 10% by weight and having a pH ranging from 1 to 7, is bleached with ozone in the presence of 0.1% to 1.0% by weight of a cationic surfactant.

15 Claims, No Drawings

PROCESS FOR BLEACHING WOOD PULP WITH OZONE IN THE PRESENCE OF A CATIONIC SURFACTANT

This is a continuation, of application Ser. No. 604,725, filed Aug. 14, 1975, now abandoned.

BACKGROUND OF THE INVENTION

1. Field of the Invention

This invention relates to a process for bleaching pulp with ozone. More particularly, it relates to bleaching pulp at low consistencies with ozone in the presence of a cationic surfactant.

2. The Prior Art

It is known that ozone is an effective bleaching chemical when applied to pulps at consistencies of say from 25 to 65%. High consistency slurries have been used because the bleaching rate of ozone at low consistencies is extremely slow. Brabender et al. in U.S. Pat. No. 2,466,633 were among the first to teach high consistency bleaching pulp with ozone. However, it was felt that early attempts to bleach with ozone were detrimental to the cellulose fibers. Because of the strong oxidizing power of ozone, there is an indiscriminate ozone oxidation attacking carbohydrate and lignin concurrently producing significant degradation of fibers over extended reaction times.

Wade in U.S. Pat. No. 3,318,657 claimed to have overcome this problem by treating cellulose fibers prior to contact with ozone with an alkali metal borohydride. Later, Ancelle et al. in U.S. Pat. No. 3,451,888 disclosed the use of wetted ozonized air as a bleaching agent.

It is evident that the development of a commercially acceptable ozone-based bleaching system would eliminate chlorine containing bleach effluents and reduce chemical costs. It is, therefore, the general object of this invention to provide a commercially acceptable ozone pulp-bleaching process.

Another object of this invention is to provide a process for bleaching pulp with ozone at low consistencies.

Other objects, features and advantages of the invention will be evident from the following detailed description.

SUMMARY OF THE INVENTION

It has been found that the presence of 0.01 to 1.0%, based on oven dried pulp, of a cationic surfactant improves the ozone reaction rate dramatically at low consistencies, i.e., 0.1% to about 20.0%, as well as the bleaching efficiency. The bleaching efficiency is the quantity of ozone required for a given increase in brightness or decrease in Kappa Number.

DESCRIPTION OF THE PREFERRED EMBODIMENTS

In the process of this invention, an aqueous slurry of wood pulp from a kraft, sulfite or soda process is treated, at a consistency between about 0.1% and 20.0%, preferably between 1% and 10% and most preferably between 1% and 5%, by weight based on oven dried (O.D.) pulp, with ozone.

To the aqueous slurry of cellulose pulp is added from 0.01% to 1.0%, preferably 0.1% to 0.5%, based on oven dried pulp, of a cationic surfactant. The cationic surfactant may be added prior to or co-currently with the ozone. The cationic surfactants are of the following type

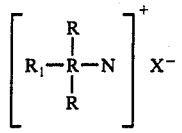

wherein R is $CH_3$ or $CH_2CH_3$, $R_1$ is an alkyl radical containing from 3 to 15 carbon atoms, an aryl radical or an alkylaryl radical, and X is an inorganic anion, such as a halogen. Preferred surfactants include hexadecyl trimethyl ammonium bromide, nonyl trimethyl ammonium bromide and dodecyl trimethyl ammonium chloride.

In solution, the surfactant apparently performs a number of functions which increase the ozone reaction rate. The cationic surfactant decreases the surface tension of water and this, in turn, decreases the bubble size of ozone being passed through the pulp slurry. The coalescence of the bubbles is diminished as the result of a surfactant coating forming about each bubble to provide an ionic film that repulses the approach of other bubbles. From these two effects, it follows that at a given volumetric flow rate the total surface area of all bubbles passing through the pulp slurry is greater when the cationic surfactant is present in the liquid phase.

If the rate controlling step in ozone bleaching is transfer of ozone across the gas-liquid interface, an increase of surface between these two phases increases the rate of ozone transfer to the liquid phase. When the surfactant is added to water, the transfer of ozone from gas phase to liquid phase is increased even in the case of ozonizing water in the absence of pulp. When the cationic surfactant is added to water plus pulp, a significant increase in ozone consumption and pulp bleaching occurs.

The rate enhancing effect of surfactant is believed due to at least three phenomena: (1) the surfactant produces a greater number of smaller bubbles which better disperse the gaseous reagent directly to the fiber, (2) the mass transfer area is increased because of the smaller bubbles, and (3) in the case of a cationic surfactant, the bubbles are surrounded by a positively charged film which causes a greater attraction between bubbles and fibers. Cationic bubbles may then cling to fibers and transfer ozone directly through the immobilized water layer on the fiber to the reaction sites, thereby circumventing the diffusion of ozone through the bulk liquid where it will be more susceptible to destruction by its known decomposition reaction with water.

The ozonation is carried out by passing ozone gas through the aqueous pulp slurry in an amount of say 10–80 mg./l. of oxygen or air. The time of exposure to give the desired bleaching must be determined for each fiber and is related to ozone concentration and temperature. These parameters should be adjusted so that about 0.1% to 3.0% of ozone based on the weight of the dried pulp is consumed during the process. Exposure time may require 2 hours at room temperature to 2 minutes or less at 100° C. Again, the exact conditions for each pulp must be tested individually. After ozone treatment, the pulp is washed and, if desired, adjusted to a pH required for further processing or finishing.

However, to maintain low effective surfactant applications, it is preferable in a batch type reactor to add acid to the pulp slurry before surfactant is added because the cationic surfactant may be strongly attracted to negative sites on pulp fibers and thus removed from the surrounding liquid. The ozone treatment can be carried out in an aqueous solution having a pH between 1 and 7 and preferably between 2 and 4. This may be accomplished by treating the fibers with a solution of an acid, such as hydrochloric acid, sulfuric acid, acetic acid, and the like. Acid neutralizes the anionic sites on the fiber, thereby decreasing this attraction so that more surfactant remains in solution. Nevertheless, there is always some attraction between cationic surfactant and pulp fibers.

Using the process of this invention, semi-bleached or bleached cellulosic fibers are obtained which are 5–10% brighter than fibers treated with ozone alone; and the bleaching efficiency is increased.

The process of the present invention is best illustrated by the following specific examples:

EXAMPLE 1

A 24-gram sample, sample "A", of unbleached hardwood pulp was diluted with water to a consistency of 0.5% by weight based on O.D. pulp. An ozonized oxygen stream containing 52 mg./l. ozone was passed through the pulp slurry at room temperature for 2 hours.

For comparison, a second 24-gram sample of the same hardwood pulp, sample "B", was diluted to a 0.5% consistency treated at the same conditions, except 0.4% by weight O.D. pulp of hexadecyl trimethyl ammonium bromide was added.

A third 24-gram sample of the same hardwood pulp, sample "C", was diluted to 0.5% consistency treated at the same conditions as sample B, except 1.0% by weight of O.D. pulp of sulfuric acid was added and the time was 1 hour.

A fourth identical sample, sample "D", was treated at the same conditions as sample A (no surfactant added), except 1.0% by weight on O.D. pulp of sulfuric acid was added and the time was 1 hour.

The main characteristics of the ozone bleached pulps are compared in the following table.

| | Unbleached Sample | A | B | C | D |
|---|---|---|---|---|---|
| Consistency, % on O.D. Pulp | 0.5 | 0.5 | 0.5 | 0.5 | 0.5 |
| Time, hours | — | 2 | 2 | 1 | 1 |
| Surfactant Added | None | None | Yes | Yes | None |
| Acid Added | None | None | None | Yes | Yes |
| pH | 6 | 5–6 | 5–6 | 3 | 3 |
| 0.5% CED Viscosity, cp. | 14.1 | 8.6 | 7.4 | 7.7 | 9.51 |
| 25 Ml. K No. | 11.6 | 3.8 | 3.5 | 2.1 | 4.1 |
| Ozone Consumed on O.D. Pulp, % | 0 | 2.7 | 2.74 | 2.22 | 1.5 |
| G.E. Brightness, % | 25.4 | 48.2 | 51.6 | 62.2 | 47.2 |

The increased G.E. brightness of samples B and C shows clearly the desirable effects of the cationic surfactant over the use of ozone without the surfactant. Sample C with the addition of sulfuric acid likewise also illustrates the bleaching efficiency and increased reaction rate.

EXAMPLE 2

A second unbleached hardwood pulp, 50.0-gram O.D. sample "E", at a consistency of 1.0% by weight based on O.D. pulp, was treated with 47 mg./l. of ozone in oxygen for 1.5 (no surfactant added).

Another sample "F", identical to sample E, was treated at the same conditions as sample E, except 44 mg./l. ozone in oxygen was used; 0.4% by weight O.D. pulp of hexadecyl trimethyl ammonium bromide and 5.0% by weight O.D. pulp of sulfuric acid were also added.

The results are compared in the following table.

| | Unbleached Sample at 1% Consistency | E | F |
|---|---|---|---|
| 0.5% CED Viscosity, cp. | 22.2 | 15.3 | 9.2 |
| 25 Ml. K No. | 11.3 | 7.6 | 4.1 |
| Ozone Consumed, % | 0 | 0.83 | 1.71 |
| G.E. Brightness, % | 27.0 | 38.1 | 56.3 |

The results show that with the addition of the surfactant to an acidified slurry a 1% consistency dramatically increased the G.E. brightness from 38.1 to 56.3 and the bleaching efficiency over 1.5 hours (0.83% to 1.71% ozone being consumed during the same time).

EXAMPLE 3

This example illustrates the utility of various cationic surfactants at different pulp consistencies.

Another portion of the unbleached hardwood pulp of Example 2, sample "G", was diluted with water and treated with ozone for 1.5 hours (no surfactant added).

Sample "H", identical to sample G, was diluted to a consistency of 1.0%; and 0.4% nonyl trimethyl ammonium bromide and 5.0% sulfuric acid were added during ozonation lowering the initial pH to about 2.

Sample "I" was identical to sample H, except dodecyl trimethyl ammonium chloride was substituted as the surfactant.

Sample "J" was a 50.0-gram sample at 3.3% consistency treated like sample G, except dodecyl trimethyl ammonium chloride was used as the surfactant.

The results are shown in the table below.

| | Unbleached Sample | G | H | I | J |
|---|---|---|---|---|---|
| Consistency, % on O.D. Pulp | 1.0 | 3.3 | 1.0 | 1.0 | 3.3 |
| Ozone, mg./l. | — | 37 | 43 | 44 | 36 |
| 0.5% CED Viscosity, cp. | 22.2 | 18.1 | 10.3 | 9.1 | 10.1 |
| 25 Ml. K No. | 11.3 | 8.5 | 4.0 | 2.7 | 2.6 |
| Ozone Consumed on O.D. Pulp, % | — | 0.43 | 1.20 | 1.99 | 1.37 |
| G.E. Brightness, % | 27.0 | 30.3 | 52.9 | 62.7 | 56.5 |

These results clearly show the effectiveness of various cationic surfactants.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. A process for bleaching wood pulp comprising the steps of:

(a) mixing a low consistency wood pulp slurry with 0.01% to 1.0% cationic surfactant by weight based on ovendried pulp, said slurry comprising from 0.1% to 10% by weight of ovendried wood pulp and having a pH range from 1 to 7 and, said cationic surfactant having a formula:

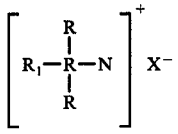

wherein,

R is $CH_3$ or $CH_2CH_3$, $R_1$ is an alkyl radical containing from 3 to 15 carbon atoms, an aryl radical, or an alkylaryl radical and X is a halogen; and (b) introducing ozone gas into said wood pulp slurry containing said cationic surfactant for a time effective to bleach said wood pulp.

2. The process according to claim 1 wherein the pH of said slurry is adjusted to between 2 and 4.

3. The process according to claim 1 including the further step of:

(c) recovering bleached wood pulp having a G.E. brightness value of at least 52.9%.

4. The process according to claim 1, whereby acid is mixed with said slurry before said cationic surfactant is added to said slurry.

5. The process according to claim 4 wherein said acid added is selected from the group consisting of sulfuric acid, hydrochloric acid, and acetic acid.

6. The process according to claim 1 wherein said slurry contains an aqueous acid to decrease the attraction of said cationic surfactant to said wood pulp.

7. The process according to claim 1 wherein said slurry has a consistency ranging from 1.0% to 5.0% by weight of ovendried pulp.

8. The process according to claim 7 wherein said cationic surfactant is present in an amount ranging from 0.1% to 0.5% by weight of ovendried pulp.

9. The process according to claim 1 wherein said cationic surfactant is a member of the group consisting of hexadecyl trimethyl ammonium bromide, nonyl trimethyl ammonium bromide and dodecyl trimethyl ammonium bromide.

10. The process according to claim 1 wherein said wood pulp is obtained from a Kraft, sulfite or soda pulping process.

11. The process according to claim 1 wherein said ozone is introduced at a rate sufficient to result in the consumption of from about 0.1 to about 3% ozone based on the weight of the oven dried pulp being treated during the process.

12. A process for bleaching wood pulp which comprises:

(a) mixing an aqueous slurry of wood pulp, at a consistency from 0.1% to 10% by weight of ovendried pulp and having a pH ranging from 2 to 7, with 0.01% to 1.0% cationic surfactant by weight based on ovendried pulp, said cationic surfactant being selected from the group consisting of

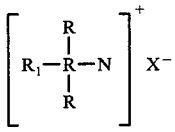

wherein R is $CH_3$ or $CH_2CH_3$, $R_1$ is an alkyl radical containing from 3 to 15 carbon atoms, an aryl radical or an alkylaryl radical and X is a halogen; and (b) bleaching said slurry, containing said cationic surfactant, with ozone at a temperature from room temperature to about 100° C. until from 0.5% to about 3.0% by weight of ozone based upon the weight of ovendried pulp is consumed.

13. The process according to claim 12 wherein said aqueous slurry of pulp is at a consistency from 1.0% to 5.0% by weight of ovendried pulp.

14. The process according to claim 13 wherein said cationic surfactant is present in an amount from 0.1% to 0.5% by weight of ovendried pulp.

15. The process according to claim 14 wherein said cationic surfactant is a member of the group consisting of hexadecyl trimethyl ammonium bromide, nonyl trimethyl ammonium bromide and dodecyl trimethyl ammonium bromide.

* * * * *

UNITED STATES PATENT AND TRADEMARK OFFICE

CERTIFICATE OF CORRECTION

PATENT NO. : 4,119,486

DATED : October 10, 1978

INVENTOR(S) : Robert C. Eckert

It is certified that error appears in the above-identified patent and that said Letters Patent are hereby corrected as shown below:

In column 2, line 5, " $\left[ R_1 - \overset{\overset{R}{|}}{\underset{\underset{R}{|}}{R}} - N \right]^+ X^-$ " should read -- $\left[ R_1 - \overset{\overset{R}{|}}{\underset{\underset{R}{|}}{N}} - R \right]^+ X^-$ --.

In column 3, line 68, after "1.5" insert --hours--.

In the claims, column 5, line 1, "range" should read --ranging--; and "," appearing after the word "and" should be deleted.

UNITED STATES PATENT AND TRADEMARK OFFICE

CERTIFICATE OF CORRECTION

PATENT NO. : 4,119,486

DATED : October 10, 1978

INVENTOR(S) : Robert C. Eckert

It is certified that error appears in the above-identified patent and that said Letters Patent are hereby corrected as shown below:

In the claims, column 5, line 5, and column 6, line 20,

" 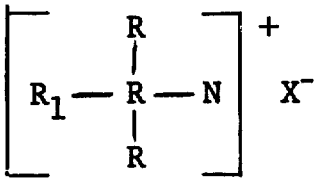 " should read -- 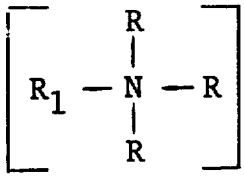 --.

Signed and Sealed this

Sixth Day of March 1979

[SEAL]

Attest:

RUTH C. MASON
*Attesting Officer*

DONALD W. BANNER
*Commissioner of Patents and Trademarks*